US005520964A

United States Patent [19]

Carey, II et al.

[11] Patent Number: 5,520,964

[45] Date of Patent: May 28, 1996

[54] METHOD OF COATING A METAL STRIP

[75] Inventors: Jon F. Carey, II, Follansbee, W. Va.; Mehrooz Zamanzadeh, Pittsburgh, Pa.

[73] Assignee: The Louis Berkman Company, Steubenville, Ohio

[21] Appl. No.: 465,449

[22] Filed: Jun. 5, 1995

Related U.S. Application Data

[62] Division of Ser. No. 380,372, Jan. 30, 1995, Pat. No. 5,480,731, which is a continuation of Ser. No. 153,026, Nov. 17, 1993, Pat. No. 5,395,703, which is a division of Ser. No. 858,662, Mar. 27, 1992, Pat. No. 5,314,758.

[51] Int. Cl.[6] ..... B32B 9/00

[52] U.S. Cl. ..... 427/431; 427/433; 427/434.2; 427/436

[58] Field of Search ..... 427/431, 433, 427/434.2, 436

[56] References Cited

U.S. PATENT DOCUMENTS

| | | | |
|---|---|---|---|
| 84,205 | 11/1868 | Mills . | |
| 2,210,593 | 8/1940 | McCullough | 75/175 |
| 2,374,926 | 5/1945 | Fink | 117/51 |
| 2,533,048 | 12/1950 | Rodgers | 117/52 |
| 3,058,856 | 10/1962 | Miller | 148/16 |
| 3,105,022 | 9/1963 | Boggs | 204/37 |
| 3,231,127 | 1/1966 | Virzi | 220/52 |
| 3,728,144 | 5/1973 | Poucke | 117/51 |
| 3,860,438 | 1/1975 | Shoemaker | 117/50 |
| 3,962,501 | 6/1976 | Ohbu et al. | 427/433 |
| 3,966,564 | 6/1976 | Hyner | 204/43 |
| 4,015,950 | 5/1977 | Galland et al. | 428/648 |
| 4,152,471 | 5/1979 | Schnedler et al. | 427/310 |
| 4,177,326 | 12/1979 | Windal et al. | 428/645 |
| 4,216,250 | 9/1980 | Nakayama et al. | 427/289 |
| 4,321,289 | 3/1982 | Bartsch | 427/287 |
| 4,330,574 | 5/1982 | Pierson et al. | 427/319 |
| 4,416,920 | 11/1983 | Pierson et al. | 427/349 |
| 4,758,407 | 7/1988 | Ballentine et al. | 420/560 |
| 4,778,733 | 10/1988 | Lubrano et al. | 428/647 |
| 4,806,309 | 2/1989 | Tulman | 420/562 |
| 4,879,096 | 11/1989 | Naton | 420/561 |
| 4,883,723 | 11/1989 | Kilbane et al. | 428/653 |
| 4,934,120 | 6/1990 | Boyd | 52/518 |
| 4,987,716 | 1/1991 | Boyd | 52/520 |
| 4,999,258 | 3/1991 | Wake et al. | 428/632 |
| 5,023,113 | 6/1991 | Boston et al. | 427/320 |
| 5,134,039 | 7/1992 | Alexander et al. | 428/614 |
| 5,175,026 | 12/1992 | Bertol et al. | 427/307 |
| 5,202,002 | 4/1993 | Tsuchinaga et al. | 204/145 |
| 5,314,758 | 5/1994 | Carey, II et al. | 428/648 |
| 5,354,624 | 10/1994 | Carey, II | 428/647 |
| 5,395,703 | 3/1995 | Carey, II et al. | 428/648 |
| 5,480,731 | 1/1996 | Carey, II et al. | 428/648 |

FOREIGN PATENT DOCUMENTS

| | | | |
|---|---|---|---|
| 0012437 | 6/1980 | European Pat. Off. | B05P 1/36 |
| 0261078 | 3/1988 | European Pat. Off. | C23C 2/00 |
| 746337 | 5/1933 | France . | |
| 1457769 | 9/1966 | France . | |
| 2052324 | 3/1971 | France | C23L 1/00 |
| 2281995 | 4/1974 | France | C23L 1/04 |
| 2713196 | 10/1978 | Germany . | |
| 42-18219 | 10/1967 | Japan . | |
| 49-54230 | 5/1974 | Japan . | |
| 59-41430 | 3/1984 | Japan | C22C 13/00 |
| 59-96238 | 6/1984 | Japan | C22C 13/00 |
| 60-208465 | 10/1985 | Japan | C23L 2/38 |
| 528558 | 10/1932 | United Kingdom . | |
| 581604 | 10/1946 | United Kingdom . | |
| 796128 | 6/1958 | United Kingdom . | |
| 1008316 | 10/1965 | United Kingdom . | |
| 1517454 | 6/1978 | United Kingdom | C23L 1/02 |
| 1513002 | 6/1978 | United Kingdom | C23L 1/06 |
| 2022158 | 2/1981 | United Kingdom | F16L 33/14 |
| 2055158 | 2/1981 | United Kingdom | F16C 33/14 |
| 1588808 | 4/1981 | United Kingdom | C22C 18/00 |
| 2099857 | 12/1982 | United Kingdom | C23C 1/02 |
| 2117414 | 10/1983 | United Kingdom | C23C 1/06 |
| 2265389 | 9/1993 | United Kingdom | C23C 2/02 |
| 2276887 | 10/1994 | United Kingdom | C23L 2/06 |

OTHER PUBLICATIONS

*Metals Handbook,* The American Society for Metals, "Metallic Coatings", pp. 703–721; Surface Treatments pp. 725–732; Tin and Tin Alloys, pp. 1063–1076; Zinc and Zinc Alloys pp. 1077–1092 1948.

Van Nostrand's Scientific Encyclopedia, 6th Edition, vol. 1, 1983; pp. 94–96—Definition of "Alloys"; p. 1322—Definition of Galvanizing.

Van Nostrand's Scientific Encyclopedia, 6th Edition, vol. 11, 1983, pp. 2832–2834—Definition of "Tin"; pp. 3059–3062—Definition of Zinc McGraw–Hill Encyclopedia of Science & Technology, 6th Edition, 1987, p. 517.

"Tin and Tin Alloys" Gosner, Bruce W., pp. 1063–1070.

"Hot Dip Tin Coating of Steel and Cast Iron" Metals Handbook, 9th Ed., vol. 5, 1983, pp. 351–355.

Federal Specification QQ–T–201F, 12 Nov. 1986, "Terne Plate, for Roofing and Roofing Products" pp. 1–8.

*Primary Examiner*—Benjamin Utech

*Attorney, Agent, or Firm*—Vickers, Daniels & Young

[57] ABSTRACT

Various metal coatings have been used for many years to inhibit oxidation of metals exposed to the natural elements of the atmosphere over a period of time. Terne alloy coatings which normally contain about 20% tin and about 80% lead are some of the most popular metal coating treatments to resist corrosion. The special formulation of the present invention reformulates the terne coating to constitute a tin and lead based coating where tin constitutes at least 90% of the terne and lead amounts to less than 0.1% and preferably less than 0.05% of the terne. The low lead terne coating may also include antimony and bismuth to provide strength and hardness to the low lead terne formulation having corrosion resistive qualities similar to that of standard terne coating formulations.

20 Claims, No Drawings

METHOD OF COATING A METAL STRIP

This application is a divisional of Ser. No. 380,372, now U.S. Pat. No. 5,480,731, filed Jan. 30, 1995, which is a continuation of Ser. No. 153,026, now U.S. Pat. No. 5,395, 703, filed Nov. 17, 1993, which is a divisional of Ser. No. 858,662, now U.S. Pat. No. 5,314,758, filed Mar. 27, 1992.

The present invention relates to the art of metal roofing materials and more particularly to a terne coating formulation containing extremely low levels of lead hot dipped onto a roofing sheet metal material.

INCORPORATED BY REFERENCE

As background material so that the specification need not specify in detail what is known in the art, Federal Specification No. QQ-T-201F and an article entitled "The Making, Shaping and Treating of Steel", U.S. Steel Corporation, 1957, pp. 655–659, Sci. Lib. Coll No. TN T30 C16, 1957 are incorporated herein by reference and made part hereof. Similarly, assignee's U.S. Pat. Nos. 4,987,716 and 4,934, 120 illustrate metal roofing systems of the type to which this invention relates and are incorporated herein by reference.

BACKGROUND OF THE INVENTION

For many years, metal roofing systems, specifically stainless steel and low carbon steel sheet, in various sheet gauge thicknesses, have been treated with terne metal alloys. When the terne coated steel sheets are assembled into a roof covering, adjacent sheet edges are folded over one another and the seam then formed, typically a standing seam, usually soldered vis-a-vis the terne coating to produce a waterproof joint. Today, the terne coated steel sheets are either preformed or formed at the job site onto roofing pans with bent edges which abut edges of adjacent pans which are then pressed or rolled into the seam. Similarly, caps, cleats, etc. are likewise formed from the terne coated sheet. In addition to providing for soldering of the seams, the terne coating inhibits rusting or oxidation of the metal sheet which would otherwise occur over time.

Terne or terne alloy is a term commonly used to describe an alloy containing about 80% lead and the remainder tin. The terne alloy is conventionally applied to the metals by a hot dip process wherein the metal is immersed into a molten bath of terne metal. The terne coating greatly inhibits the formation of ferrous oxide on the metal thus preventing corrosion and extending the life of the metal. The corrosion resistive properties of the terne alloy are due to the stability of elemental lead and tin and the lead-tin oxide which forms from atmospheric exposure.

Although terne coated sheet metals have excellent corrosive resistive properties and have been used in various applications such as roofing, terne coated metal roofing materials have recently been questioned due ho environmental concerns. Terne coated metals contain a very high percentage of lead and commonly include over 80 weight percent of the terne alloy. Although the lead in terne alloys is stabilized, there is concern about leaching of the lead from the terne alloy. As a result, terne coated materials have been limited from use in various applications, such as aquifer roofing systems. The concern of lead possibly leaching from terne coated roofing systems renders normal terne coating inadequate and undesirable as a metal roofing coating for these types of roofing applications.

Another disadvantage of terne coated materials is the softness of the terne layer. As noted, terne coated metal sheets are commonly formed into varying shapes. The machines that bend the metal sheets periodically damage the terne coating during bending process. The terne coating is susceptible to damage due to the abrasive nature of the forming machines.

A further disadvantage of using normal terne coated metals is that newly applied terne is highly reflective to light. Use of terne roofing materials on buildings near or within an airport can produce a certain amount of glare to pilots taking-off and landing. Due to the highly stable nature of terne alloys, terne coated metals take about one and one-half to two years before oxidation of the terne begins to dull the terne alloy surface. The present invention deals with these disadvantage of normal terne coated roofing sheet material.

SUMMARY OF THE INVENTION

It is a principal feature of the present invention to provide a low lead terne formulation for use on roofing materials wherein the coated roofing materials typically have a stainless steel base or a carbon steel base and exhibit excellent corrosive resistive properties.

In accordance with the principal feature of the invention, there is provided a roofing material typically of stainless steel or carbon steel coated with a terne alloy metal containing an extremely low weight percentages of lead. The low lead terne coating consists of a large weight percentage of tin and a lead content of less than 0.10 percent by weight and preferably less than 0.05 percent by weight which produces a terne coating that is both corrosion resistant for preventing oxidation of the roofing material and is pliable and abrasive resistant so that it can be formed into various roofing components without cracking or otherwise damaging the terne coating.

In accordance with another aspect of the invention, bismuth and antimony are added to the low lead terne which produces a unique combination of bismuth, antimony, lead and tin for forming a protective coating which is highly resistive to corrosion when exposed to the elements of the atmosphere, especially in rural environments. Specifically, bismuth and antimony are added to the low lead terne to both strengthen the terne and to inhibit crystallization of the tin. Pure tin is a soft and malleable metal. Because of the physical properties of tin, tin can be worn down and/or deformed if placed in an abrasive environment. Since tin constitutes a large percentage of the low lead terne, many of the physical characteristics of elemental tin dominate the properties of the terne. Although tin is a stronger and harder substance than lead, thus making the low lead terne more abrasive resistant than standard terne alloys, high abrasive environments may damage the low lead terne coating. The addition of bismuth and antimony significantly enhances the hardness and strength of the low lead terne to increase resistivity to wear caused by abrasion. The bismuth and antimony further combine with the tin in the low lead terne to inhibit crystallization of the tin in cold weather. When tin crystallizes, it may not properly bond to stainless steel or low carbon steel roofing materials. As a result, the low lead terne may prematurely flake off and expose the roofing materials to the atmosphere. The addition of bismuth and antimony prevents crystallization of the tin to eliminate possible problems of the low lead terne bonding to the roofing materials.

In accordance with yet another feature of the present invention, a metal coloring agent is added to the low lead terne to dull the reflective properties of the newly applied terne on the roofing materials while also adding additional strength to the terne to further resist abrasion which may damage the terne coating. Newly applied, the low lead terne has a shiny silver surface which is very reflective. In some roofing applications this highly reflective property is unwanted. By adding metallic copper to the low lead terne, the newly coated roofing materials exhibit a duller, less reflective surface. Metallic cooper adds a reddish tint to the low lead terne which significantly reduces the light reflective properties of the coating. Copper may also assists in the corrosive resistive properties of the terne. When copper oxidizes, the oxide forms a protective layer to shield the roofing materials from the atmosphere. The copper oxide also contributes to dulling the terne surface.

In accordance with an additional feature of the present invention, zinc metal is added to further increase the hardness of the tin based alloy while also contributing to the corrosion resistance of the low lead terne since oxidation of zinc produces a zinc oxide coating which assists in shielding the roofing materials from the elements of the atmosphere.

In accordance with another feature of the present invention, the low lead terne exhibits excellent soldering characteristics such that various electrodes including lead and no-lead electrodes can be used to weld the coated roofing materials together.

The primary object of the present invention is the provision of a roofing material treated with a low lead terne coating having high corrosion resistant properties.

Another object of the present invention is the provision of a roofing material treated with a low lead terne containing at least 90% tin and less than 0.10% lead by weight composition.

Yet another object of the present invention is a low lead terne, as defined above, containing antimony and/or bismuth to harden the low lead terne and to inhibit crystallization of the tin in the terne.

Another object of the invention is the provision of a roofing material coated with low lead terne containing zinc and/or iron to enhance the strength and hardness of the terne.

Another object of the present invention is the provision of a roofing material treated with low lead terne which includes metallic copper to dull the surface of the terne.

Still yet another object of the invention is to provide a low lead terne coating applied to a base metal sheet which coated base metal sheet can be subsequently sheared and formed in a press to make roof pans, cleats, caps and the like, which can be subsequently assembled on site by pressing, etc. into a roof without the terne coating flaking or chipping during pressing, bending or shearing of the metal sheet.

Still yet another specific object of the invention is to provide a low lead terne coating which can be applied to a roofing base metal and thereafter preformed into roof pans which are subsequently seamed at the site either by press seams or soldered seams into waterproof joints.

Still yet another object is to provide a low lead terne coating which is suitable for roofing application and which conforms to aforementioned federal specification.

A still further object is to provide a low lead terne coating which has superior corrosive characteristics permitting a thinner coating of the terne to the sheet steel than that which is required for conventional terne coatings with the high lead content.

Another object of the invention is to provide a low lead terne coating that can be soldered with conventional tin-lead solders or no-lead solders.

These and other objects and advantages will become apparent to those skilled in the art upon a reading of the detailed description of the invention set forth below.

DESCRIPTION OF THE PREFERRED EMBODIMENT

The low lead terne is a corrosion resistive coating applied to stainless steel or low carbon steel roofing materials to prevent the roofing materials from prematurely corroding when exposed to the atmosphere. The low lead terne contains a large weight percentage of tin and a very small weight percentage of lead. The low lead terne is both highly corrosive resistant, abrasive resistant, pliable, weldable and environmentally friendly. The low lead terne can be applied to both stainless steel and carbon steel roofing materials by preferably using conventional hot dipping techniques, but may be applied by other means, i.e. electroplating air knife process, etc. Protective coating containing high weight percentages of tin have not been used before on stainless steel roofing materials. The low lead terne can be applied to both 304 stainless and 316 stainless steel; however application of the terne is not limited to only these two types of stainless steel. The low lead terne binds with the stainless steel to form a durable protective coating which is not easily removable. The low lead terne also forms a strong bond with carbon steel, especially with low to medium carbon steel. Treating the surfaces of the carbon steel with an organic coating may further strengthen the bonding between the terne and carbon steel or stainless steel.

The amount of corrosion resistance protection provided by the low lead terne coating is of primary importance. Carbon steel and stainless steel oxidize when exposed to the atmosphere. Over a period of time the oxidized steel, commonly termed corrosion, begins to weaken and disintegrate the steel. The coating of the steel with low lead terne acts as a barrier to the atmosphere which prevents the steel from corroding. Although the low lead terne oxidizes when exposed to the atmosphere, the rate of oxidation is significantly slower than oxidation rates of steel. The slower oxidation rates of the low lead terne is in part due to the stability of tin. By coating steel with the low lead terne, the life of the roofing materials is extended beyond the usable life of the structure the roof materials are used on. The pliability of the low lead terne is also important when being used in roofing systems since roofing materials are formed into various shapes and may be folded to form seams to bind the roofing materials together to form a roofing system. A roof material coating that forms a rigid or brittle coating on the roofing material may crack or may prevent the roofing materials to be properly shaped. Furthermore, a roofing material coating Which is brittle or rigid may hinder or even prevent the roofing material from being properly folded to form the necessary seams to attach the roofing materials together. Metals such as zinc are known for their highly rigid nature. A roofing material coated with zinc, commonly known as galvanized steel, cannot be folded without fear of damaging the protective zinc coating. In addition to the low lead terne having to be pliable and corrosion resistant, the terne must be solderable since roofing panels are commonly soldered together. The low lead terne coating of the present invention meets all these requirements by containing extremely low levels of lead which produces a highly corrosive resistant metallic coating with relatively high pliability and can be soldered to other materials.

The low lead terne coating applied to low carbon steel or stainless steel roofing materials comprises a tin content of least 90 weight percent of the alloy. It is believed that such high concentrations of tin have not previously been applied to stainless steel roofing materials. Prior anti-corrosion coatings applied to stainless steel include zinc coatings containing trace amounts of tin and standard terne alloy coatings containing about 10% to 20% tin. Elemental tin is a relatively soft and stable element which exhibits unusually high corrosion resistant properties in a variety of atmospheric conditions. As a result, the low lead terne which contains at least 90% tin is highly pliable and high corrosive resistant. The weight percent of the lead in the low lead terne is less than about 0.10%. This amount of lead is substantially smaller than in standard terne alloys wherein the amount of lead in the terne ranges between 80% to 90%.

The terne also exhibited high resistance to leaching of any lead which may be contained in the terne, thus expanding the uses of roofing mate/rials treated with the low lead terne.

The low lead terne contains a very large weight percentage of tin. Preferably the tin content is greater than 90% and can be as much as 99.9%. The lead content of the low lead terne can range between 0.001 to 0.10 weight percent. Preferably, the lead content is less than 0.05 weight percent and about 0.01 percent. The low lead terne composition more than reverses the tin and lead weight percentages of conventional terne alloys. Prior practice attempted to limit the tin concentration to an amount sufficient enough to form a smooth bond with the ferrous base material. Conventional formulations limit the weight percentage of tin to about 20%. The 90 plus percent tin formulations for the low lead terne substantially deviate from prior terne formulations. Tin is the bonding agent for terne alloys. Lead does not bond with ferrous materials. The high concentrations of tin in the low lead terne of the present invention substantially increases the uniformity and strength of the bond between the low lead terne and the roofing materials as compared with standard terne alloy coatings. The superior bonding characteristics of the low lead terne makes the coating ideal for use with materials that are formed and shaped after being coated.

The low lead terne may also contain bismuth and antimony. The bismuth contained in the low lead terne typically ranges between 0.0 to 1.7 weight percent of the alloy and preferably is about 0.5 weight percent. Antimony may also be added to the terne at amounts ranging between 0.0 to 7.5 weight percent. The tin based alloy preferably contains bismuth and/or antimony since these two elements add to abrasive resistive properties of the terne and prevent the tin in the terne from crystallizing which may result in flaking of the terne from the stainless steel or low carbon steel roofing materials. Tin begins to crystalize when the temperature begins to drop below 56° F. (13.2° C.). Only small amounts of antimony or bismuth are needed to prevent the tin from crystallizing. Typically, amounts of less than 0.5 weight percent are required to adequately inhibit crystallization of the tin which may result in the terne prematurely flaking. Antimony and/or bismuth in weight percentage amounts greater than 0.5% are used to harden the low lead terne.

Industrial grade tin can be used as the tin source for the low lead terne. Industrial grade tin is known to contain trace amounts of contaminants such as cobalt, nickel, silver and sulphur. It has been found that these elements do not adversely affect the corrosive resistive properties of the low lead tin based alloy system so long as the weight percentages of each of these elements is very small.

Copper may be added to low lead terne to strengthen the terne and to reduce the reflectivity of the terne. The amount of copper metal in the terne may range between 0.0 to 2.7 weight percent of the terne. The desired color of the terne will determine the amount of copper used.

Zinc metal may also be added to the terne to further increase the abrasion resistance of the terne. Zinc metal may be added to the terne in weight percentage amounts between 0.0 to 1.5. The amounts of zinc metal added will depend on the desired hardness of the terne. Small amounts of iron may also be added to the terne in weight percentage amounts between 0.0 to 0.1 to further increase the hardness and strength of the terne.

Aluminum and cadmium have been found to adversely affect the corrosive resistive properties of the low lead terne. Preferably the weight percentages of aluminum and cadmium should be less than 0.05% cadmium and 0.001% aluminum.

Examples of low lead terne systems which have exhibited the desired characteristics as mentioned above are set forth as follows:

| Alloy Ingredients | A | B | C | D | E | F | G |
|---|---|---|---|---|---|---|---|
| Antimony | 0.5 | 0.75 | 7.5 | 2.5 | 0.75 | 1.0 | — |
| Bismuth | 1.7 | 0.5 | — | — | 0.5 | 0.5 | 0.5 |
| Copper | — | — | 2.7 | 2.0 | — | — | — |
| Zinc | 0.001 | 0.5 | — | 0.5 | 0.5 | — | — |
| Lead | ≦0.05 | ≦0.05 | ≦0.05 | ≦0.05 | ≦0.05 | ≦0.05 | ≦0.05 |
| Iron | — | 0.1 | — | — | 0.1 | 0.1 | 0.1 |
| Tin | Bal. | Bal. | Bal. | Bal | Bal. | Bal. | Bal. |

Generally formulations of the low lead terne includes in weight percent amounts: 0.001–0.10% lead, 0.0–2.5% antimony, 0.0–0.5% bismuth, 0.0–2.7% copper, 0.0–0.1% iron, 0.5–1.5% zinc and the remainder tin.

The thickness of the low lead terne coating may be varied depending on the environment in which the treated roofing system is used. The low lead terne exhibits superior corrosive resistant properties in rural environments, thus requiring a thinner terne coating. The low lead terne also resists corrosion in industrial and marine environments, but may require a slightly thicker coating. Conventional low lead terne coating thickness typically can range between 0.0003 inches to 0.2 inches. While roofing sheet steel can be coated with the low lead terne of the present invention at such thickness, the thickness of the terne coating is based on the anticipated life of the building the roofing materials are applied to and the environment in which the roofing materials are used. Roofing materials coated with low lead terne of 0.001 inches to 0.002 inches are preferably used in all types of environments, thus reducing the price of the roofing materials. The thinner coatings may be applied by an air knife process or electroplating process instead of the conventional hot dip process. These thickness ranges for the low lead terne are applicable to both stainless steel and carbon steel roofing sheets.

The low lead terne is designed to be used in all types of roofing applications. The low lead terne coating roofing materials can be used for standing seam and press fit (mechanical joining, see assignee's U.S. Pat. No. 4,987,716 patent) applications. In standing seam applications, the edges of the roofing materials are folded together and then soldered to form a water tight seal. The low lead terne inherently includes excellent soldering characteristics. When the low lead terne is heated, it has the necessary wetting properties to produce a tight water resistant seal. As a result, the low lead terne acts as both a corrosive resistive coating and a soldering agent for standing seam roofing systems. The low lead terne coated materials can be also welded with standard solders. Typical solders contain about 50% tin and 50% lead. The low lead terne has the added advantage of also being able to be soldered with low or no-lead solders. The low lead terne coated roofing materials also can be used in mechanically joined roofing systems due to the malleability of the terne. Mechanically joined systems form water tight seals by folding adjacent roof material edges together and subsequently applying a compressive force to the seam in excess of 1,000 psi. Under these high pressures, the low lead terne plastically deforms within the seam and produces a water tight seal.

The invention has been described with reference to preferred and alternate embodiments. Modifications and alterations will become apparent to those skilled in the art upon reading and understanding the detailed discussion of the invention provided for herein. This invention is intended to include all such modifications and alterations insofar as they come within the scope of the present invention.

Having thus described the invention the following is claimed:

1. A method of producing a coated metal strip having corrosion resistant properties comprising the steps of:

a) providing a metal strip from a roll of metal strip;

b) unrolling said metal strip from said roll;

c) coating said metal strip with a corrosion resistant alloy by continuously passing said strip in a longitudinal direction through a molten bath of said corrosion resistant alloy such that the residence time of said strip in said molten alloy bath is sufficient to deposit said corrosion resistant layer on said corrosion resistant alloy on the surface of said metal strip, said corrosion resistant alloy including a majority weight percent of tin, up to about 0.1 weight percent lead and an effective amount of a metallic stabilizer for inhibiting crystallization of said tin, said metallic stabilizer selected from the group consisting of antimony, bismuth and mixtures thereof; and, d) controlling the coating thickness of said corrosion resistant alloy on said metal strip to 0.0003–0.2 inch as said metal strip exists said molten bath.

2. A method as defined in claim 1, wherein said corrosion resistant alloy comprises:

| | |
|---|---|
| Tin | at least about 90% |
| Copper | 0.0–2.7% |
| Iron | 0.0–0.1% |
| Lead | 0.0–0.1% |
| Zinc | 0.0–1.5% |

and an effective amount of antimony and bismuth as a metallic stabilizer for inhibiting crystallization of said tin, said antimony present in an amount up to about 7.2% and said bismuth present in an amount up to about 1.7%.

3. A method as defined in claim 2, wherein said corrosion resistant alloy includes at least about 0.001 weight percent lead.

4. A method as defined in claim 3, wherein said corrosion resistant alloy includes less than about 0.05 weight percent lead.

5. A method as defined in claim 4, wherein said corrosion resistant alloy includes at least 95 weight percent tin.

6. A method as defined in claim 3, wherein said corrosion resistant alloy includes at least 95 weight percent tin.

7. A method as defined in claim 2, wherein said corrosion resistant alloy includes at least 95 weight percent tin.

8. A method as defined in claim 7, wherein said metal strip is stainless steel.

9. A method as defined in claim 7, wherein said metal strip is carbon steel.

10. A method of producing a coated metal strip having corrosion resistant properties comprising the steps of:

a) providing a metal strip from a roll of metal strip;

b) unrolling said metal strip from said roll;

c) coating said metal strip with a corrosion resistant alloy by continuously passing said strip in a longitudinal direction through a molten bath of said corrosion resistant alloy such that the residence time of said strip in said molten alloy bath is sufficient to deposit said corrosion resistant layer on said corrosion resistant alloy on the surface of said metal strip, said corrosion resistant alloy including a majority weight percent of tin, at least about 0.001 weight percent lead and an effective amount of a metallic stabilizer for inhibiting crystallization of said tin, said metallic stabilizer selected from the group consisting of antimony, bismuth and mixtures thereof; and, d) controlling the coating thickness of said corrosion resistant alloy on said metal strip to at least about 0.0003 inch as said metal strip exists said molten bath.

11. A method as defined in claim 10, wherein said corrosion resistant alloy comprises:

| | |
|---|---|
| Tin | at least about 90% |
| Copper | 0.0–7.2% |
| Lead | at least about 0.001% |
| Zinc | 0.0–1.5% |

and an effective amount of antimony and bismuth as a metallic stabilizer for inhibiting crystallization of said tin, said antimony present in an amount up to about 7.2% and said bismuth present in an amount up to about 1.7%.

12. A method as defined in claim 11, wherein said corrosion resistant alloy includes at least about 95 weight percent tin.

13. A method as defined in claim 12, wherein said corrosion resistant alloy includes an effective amount of copper for reducing the reflectivity of said corrosion resistant alloy.

14. A method as defined in claim 13, wherein said corrosion resistant alloy includes at least about 0.5 weight percent zinc.

15. A method as defined in claim 11, wherein said corrosion resistant alloy includes an effective amount of copper for reducing the reflectivity of said corrosion resistant alloy.

16. A method as defined in claim 15, wherein said corrosion resistant alloy includes at least about 0.5 weight percent zinc.

17. A method as defined in claim 11, wherein said corrosion resistant alloy includes at least about 0.5 weight percent zinc.

18. A method as defined in claim 11, wherein said metal strip is stainless steel.

19. A method as defined in claim 11, wherein said metal strip is carbon steel.

20. A method as defined in claim 11, wherein said corrosion resistant material includes less than about 0.1 weight percent lead.

* * * * *

Disclaimer 5,520,964—Jon F. Carey, II Follansbee, W. VA; Mehrooz Zamanzadeh, Pittsburgh, PA. METHOD OF COATING A METAL STRIP. Patent dated May 28, 1996. Disclaimer filed June 4, 2002 by the assignee, The Louis Berkmann Company.

The term of this patent shall not extend beyond the expiration date of Pat. Nos. 5,480,731; 5,489,490; 5,491,035; 5,491,036; and 5,492,772.

*(Official Gazette, September 10, 2002)*